US007013880B2

(12) United States Patent
Watanuki et al.

(10) Patent No.: US 7,013,880 B2
(45) Date of Patent: Mar. 21, 2006

(54) EGR VALVE DEVICE

(75) Inventors: Haruo Watanuki, Tokyo (JP); Satoru Hasegawa, Tokyo (JP); Sotsuo Miyoshi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/052,299

(22) Filed: Feb. 8, 2005

(65) Prior Publication Data

US 2005/0199226 A1 Sep. 15, 2005

(30) Foreign Application Priority Data

Mar. 15, 2004 (JP) ..... 2004-072896

(51) Int. Cl.
*F02B 47/08* (2006.01)

(52) U.S. Cl. ..... 123/568.2

(58) Field of Classification Search ..... 123/568.2, 123/568.31, 568.17, 568.18
See application file for complete search history.

(56) References Cited

U.S. PATENT DOCUMENTS 6,247,461 B1 * 6/2001 Smith et al. ..... 123/568.2
6,279,552 B1 * 8/2001 Okada et al. ..... 123/568.2
2003/0116743 A1 * 6/2003 Kawasaki ..... 251/337

FOREIGN PATENT DOCUMENTS

JP 11-182355 A 7/1999

* cited by examiner

*Primary Examiner*—Mahmoud Gimie
(74) *Attorney, Agent, or Firm*—Sughrue Mion, PLLC

(57) ABSTRACT

An EGR valve device includes a valve housing having one or more exhaust-gas inlet ports and two or more exhaust-gas outlet ports, and forming an exhaust-gas passage communicated with these exhaust-gas inlet ports and exhaust-gas outlet ports; two valve-sheets disposed on the inner peripheral face of the valve housing; a valve shaft assembled into the valve housing; and two valves secured on the valve shaft, and simultaneously abutting on the respective valve-sheets when the valve shaft moved in one direction. It is arranged that the valve housing is formed of material having an axial thermal expansion coefficient larger than that of the valve shaft, and that the distance between the two valve-sheets is set so as to equal with that between the valves at the normal temperature.

6 Claims, 5 Drawing Sheets

(A)

(B)

(A)

(B)

EGR VALVE DEVICE

BACKGROUND OF THE INVENTION

1. Field of the Invention

The present invention relates to an EGR valve device installed in an exhaust-gas recirculation passage of, e.g., a diesel engine, and more particularly to an EGR valve device effective for prevention of leakage of exhaust gas when the exhaust-gas recirculation passage is closed.

2. Description of the Related Art

As a conventional EGR valve, a double-poppet type EGR valve device is well known which includes a valve housing having one or more exhaust-gas inlet ports (hereinafter referred to simply as an inlet port) and two or more exhaust-gas outlet ports (hereinafter referred to simply as an outlet port), each being connectable to the exhaust-gas recirculation passage of an engine, and forming a primary passage located on the inlet port side and a secondary passage branching out from the primary passage toward the outlet ports; a first and second valve-sheets disposed in the branched communicating portion between the primary passage and the secondary passage; a valve shaft axially movably assembled within the valve housing; and first and second valves secured on the valve shaft, and almost simultaneously abut on the first and second valve-sheets, respectively, when the valve shaft moves in one direction, to close the exhaust-gas recirculation passage. Such double-poppet type EGR valve devices are classified into largely two types: a built-in type installed in the exhaust-gas recirculation passage where the entire valve device is being exposed to the air, and a drop-in type in which part or most of the valve housing is assembled inside the recirculation passage.

The operation of the traditional EGR valve device will now be described below.

In both of the EGR valve devices of a built-in type and of a drop-in type, since one or more inlet ports and two or more outlet ports thereof are connected to the exhaust-gas recirculation passage, both of the valve housing and the valve shaft positioned within the valve housing are heated by high-temperature exhaust gas circulating through the exhaust-gas recirculation passage. However, since, as discussed in the above, the built-in type EGR valve device is assembled into the recirculation passage where the entire valve housing thereof is being exposed to the air, the valve housing is kept in the state of being always cooled down by the air, and since the valve shaft is placed within the valve housing, and exposed to high-temperature circulating exhaust gas in such a condition where the valve shaft is being shut off from the air, a temperature difference is engendered as a necessary consequence between the valve housing and the valve shaft both heated by the circulation exhaust gas. Due to this temperature difference, the valve housing and the valve shaft have different elongation percentage in the axial direction caused by their respective thermal expansions. This creates inconsistency of the distance between the two valve-sheets integrally provided within the valve housing and that between the two valves integrally secured on the valve shaft. Consequently, although the two valves are arranged with the intension of closing them simultaneously, only one valve is allowed to seat on the valve-sheet, and a gap formed between the other valve and valve-sheet widens as a temperature of the circulating exhaust gas goes up, resulting in an increase of leakage of the exhaust gas therefrom.

Moreover, even in the drop-in type EGR valve device, because the periphery of the valve housing disposed within the exhaust-gas recirculation passage is partially contacted with the exhaust-gas recirculation passage through a sealant, and the exhaust-gas recirculation passage is exposed to the air, heat of the valve housing heated by the high-temperature exhaust gas circulating through the exhaust-gas recirculation passage is propagated to the exhaust-gas recirculation passage which is being cooled down by the air. This brings about a temperature difference between the valve housing and the valve shaft. Accordingly, as with the built-in type EGR valve device, the valve housing and the valve shaft have different elongation percentage in the axial direction caused by their respective thermal expansions, and thereby only one valve is permitted to seat on the valve-sheet. The gap formed between the other valve and valve-sheet widens with rising temperature of the circulating exhaust gas, leading to increased leakage of the exhaust gas.

To this end, EGR valve devices have also been proposed in which countermeasures are taken for reducing leakage of the circulating exhaust gas caused by the difference in the elongation percentage resulting from the above-described temperature difference between the valve housing and the valve shaft. Giving an instance as one countermeasure, U.S. Pat. No. 6,247,461 B1 discloses an EGR valve device arranged such that a thermal expansion coefficient of the valve housing member located between at least two valves is equal to that of the valve shaft. Further, as another countermeasure, JP 11-182355 A (Page 7 and FIG. 2) discloses an EGR valve device arranged such that two valves do not simultaneously abut on two valve-sheets when the valves are fully closed in an ordinary temperature atmosphere, but they almost simultaneously abut on the two valve-sheets, respectively when the valves are fully closed in a high temperature atmosphere. In other words, JP 11-182355 A discloses an EGR valve device arranged such that differentiating the distance between the two valves and that between the two valve-sheets when the valves are fully closed in a predetermined temperature, a clearance is formed between one valve and one valve-sheet under the condition that the other valve abutted on the other valve-sheet.

Since the conventional EGR valve devices have been arranged as mentioned above, a temperature difference engendered between the valve housing and the valve shaft, even if it is configured that the valve housing member located between at least the two valves is set so as to have the same expansion coefficient as that of the valve shaft, as disclosed by U.S. Pat. No. 6,247,461 B1. The temperature difference creates inconsistency of the distance between the two valves incorporated on the valve shaft and that between the two valve-sheets incorporated within the valve housing. As a result, the gap, which formed between one valve and one valve-sheet under the condition that the other valve abutted on the other valve-sheet when the valves are fully closed, goes beyond the tolerance. Consequently, the higher the exhaust gas temperature, the more and more the phenomena tends to become conspicuous with the result that leakage of the circulating exhaust gas increases.

Moreover, as disclosed in the above JP 11-182355 A, when it is arranged that the two valves abut on their respective valve-sheets under the condition that the valves are fully closed in a high temperature atmosphere in which the high-temperature exhaust gas is circulating through the exhaust-gas recirculation passage, a clearance formed between one valve and one valve-sheet under the condition that the other valve seated on the other valve-sheet at the time of fully closing the valves at the normal temperature. As a result, a large amount of circulating exhaust gas leaks from the clearance.

SUMMARY OF THE INVENTION

The present invention has been made to solve the above-mentioned problems. An object of the present invention is to provide an EGR valve device that is able to prevent leakage of exhaust gas from the gap between a valve and a valve-sheet in either case, where valves are fully closed in a high temperature atmosphere in which high-temperature exhaust gas is circulating through an exhaust-gas recirculation passage and valves are fully closed at the normal temperature.

The EGR valve device according to the present invention includes a valve housing having one or more exhaust-gas inlet ports and two or more exhaust-gas outlet ports, which is connectable to the exhaust-gas recirculation passage of an engine, and forming an exhaust-gas passage communicated with these exhaust-gas inlet ports and exhaust-gas outlet ports; first and second valve-sheets disposed on the inner peripheral face of the valve housing; a valve shaft axially movably assembled into the valve housing; and first and second valves secured on the valve shaft, and almost simultaneously abut on the first and second valve-sheets, respectively to close the exhaust-gas recirculation passage when the valve shaft moves in one direction; wherein the valve housing is formed of material having an axial thermal expansion coefficient larger than that of the valve shaft, at least in the portion of the housing located between the first valve-sheet and the second valve-sheet, and the distance between the first valve-sheet and the second valve-sheet are set so as to be equal with that between the first valve and the second valve at the normal temperature.

Therefore, according to the present invention, even if a temperature difference is brought about between the valve housing and the valve shaft both heated by the high-temperature circulating exhaust gas, the elongation percentage of the valve housing and the valve shaft caused by their respective thermal expansions come to almost the same because it is arranged that the axial thermal expansion coefficient of the valve housing is larger than that of the valve shaft, as described above. This allows the two valve-sheets located within the valve housing to be kept at almost the same distance as the two valves secured on the valve shaft. For this reason, the amount of the circulating exhaust gas leaking from a small gap formed between one valve and one valve-sheet, in a valve-closed state in which the other valve abutted on the other valve-sheet, can be reduced more greatly than the conventional EGR valve devices.

DETAILED DESCRIPTION OF THE PREFERRED EMBODIMENTS

First Embodiment

Figure 1:
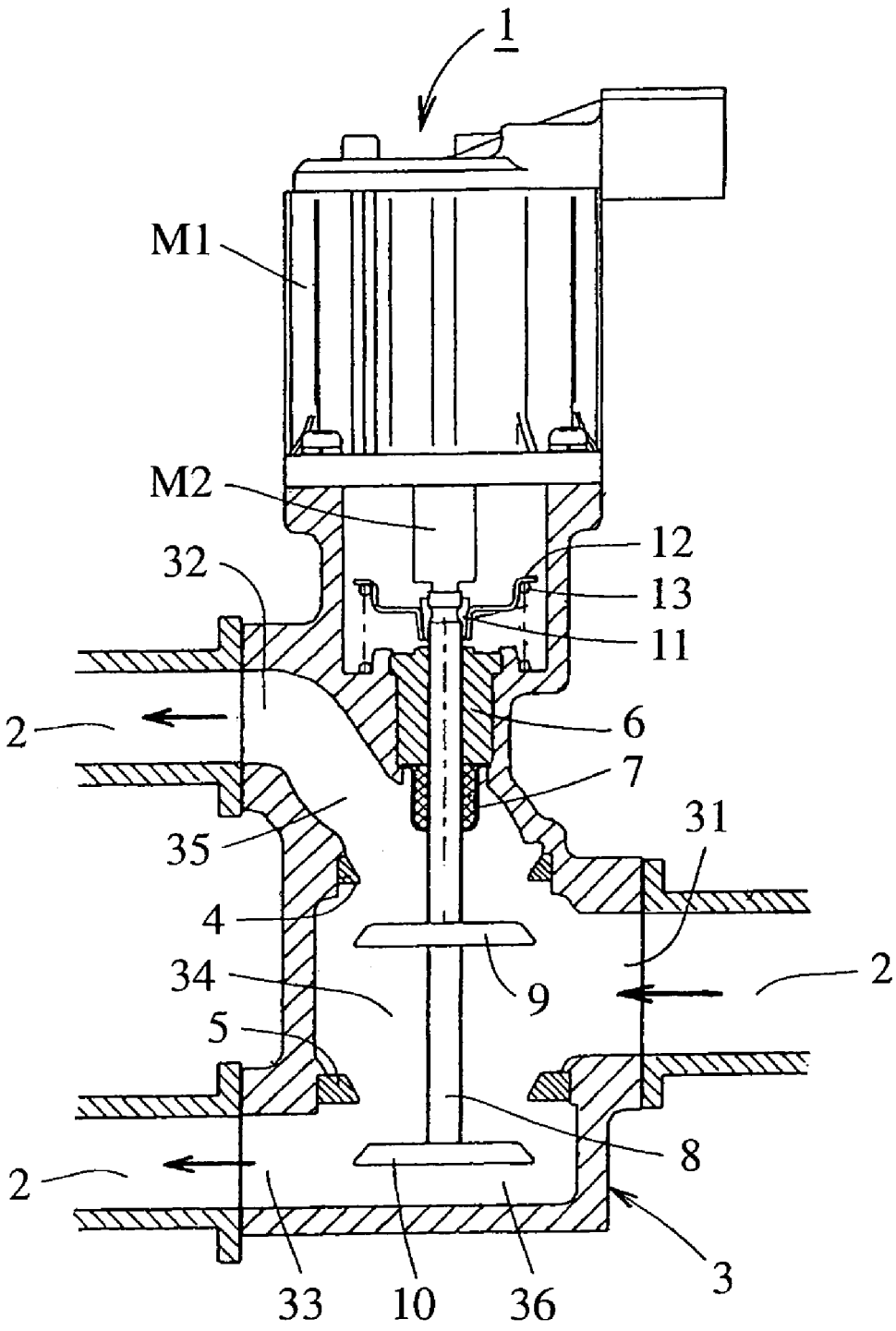
FIG. 1 is a sectional view showing a built-in type EGR valve device according to a first embodiment of the present invention.

FIG. 1 is a sectional view showing a built-in type EGR valve device according to a first embodiment of the present invention.

The EGR valve device 1 shown in FIG. 1 takes a double-poppet type structure including a valve housing 3 connected to the exhaust-gas recirculation passage 2 of an engine; first and second valve-sheets 4 and 5 disposed on the inner peripheral face of the valve housing 3 at regular intervals in the vertical direction; a valve shaft 8 axially movably assembled into the valve housing 3; and first and second valves 9 and 10 secured on the valve shaft 8, and almost simultaneously abut on the first and second valve-sheets 4 and 5, respectively, when the valve shaft 8 moves in one direction.

Explaining in full detail, the valve housing 3 has one exhaust-gas inlet port (hereinafter referred to simply as an inlet port) 31 connected with the primary side of the exhaust-gas recirculation passage 2 and two exhaust-gas outlet ports (hereinafter referred to simply as an outlet port) 32 and 33 connected with the secondary side of the exhaust-gas recirculation passage 2, and forms a series of exhaust-gas passages 34, 35, and 36 communicated with the inlet port 31 and the outlet ports 32 and 33. The series of exhaust-gas passage 34, 35, and 36 are composed of the primary passage 34 located on the inlet port 31 side and the secondary passages 35 and 36 branched out from the primary passage 34 and lead to the outlet ports 32 and 33, respectively. In the thus formed valve housing 3, the first and second valve-sheets 4 and 5 are disposed on the inner peripheral face of the housing located near the branched communicating portion between the primary passage 34 and the secondary passages 35 and 36. Moreover, in the valve housing 3, the valve shaft 8 is axially movably assembled through a bush 6 and a filter 7. On the valve shaft 8, the first and second valves 9 and 10 for almost simultaneously abutting on or separating from the first and second valve-sheets 4 and 5, respectively, are integrally secured at the same intervals as that between the first and second valve-sheets 4 and 5.

If there are one or more exhaust-gas inlet ports 31, they may be provided two or more divided ports, and this goes for the exhaust-gas outlet ports 32 and 33, too.

In addition, on the end of the valve shaft 8 projecting from the bush 6, a spring holder 12 is secured through a stopper 11. Between the spring holder 12 and the wall of the valve housing 3, a spring 13 is interposed for urging the valve shaft 8 in the valve closing direction. Additionally, on the outer end positioned on the spring holder 12 side of the valve housing 3, an actuator M1 is installed. This actuator M1 consists, e.g., of such a motor as a stepping motor or a DC motor, and its motor shaft M2 is arranged to abut on the valve shaft 8 to axially drive the valve shaft 8 against an urging force of the spring 13.

In the built-in type EGR valve device 1 thus arranged as above, where the valve housing 3 and the valve shaft 8 are formed of the same material (e.g., stainless steel), a temperature difference engenders between the valve housing 3 which is being exposed to and cooled down by the air, and the valve shaft 8 located within the exhaust-gas recirculation passage 2 and is filled with high-temperature circulating exhaust gas while being shut off from the air, under the condition that the high-temperature exhaust gas is circulating through the exhaust-gas recirculation passage 2. The difference produces a large gap between the valve housing and the valve shaft, even though the first valve 9 gets into the valve closing state where the first valve is abutted on the valve-sheet 4, when the exhaust-gas recirculation passage 2 is closed by the first and second valves 9 and 10, resulting in leakage of a lot of circulating exhaust gas from the gap.

To avoid the occurrence of such inexpedience, in the first embodiment according to the present invention, the valve housing 3 is formed, e.g., of niresist (high nickel content austenitic spheroidal graphite cast iron), and the valve shaft 8 is formed, e.g., of stainless steel having a property of a different nature from that of the cast iron. The niresist applied as a material of the valve housing 3 in the first embodiment has a thermal expansion coefficient $\alpha H$ of about 17.8E−6/° C., and in contrast, the stainless steel adopted as a material of the valve shaft 8 has a thermal expansion coefficient $\alpha R$ of about 13.6E−6/° C. In this way, the valve housing 3 and the valve shaft 8 are formed of materials each having a coefficient of linear expansion different from each other. That is, the valve housing 3 is formed of material having an axial thermal expansion coefficient $\alpha H$ larger than an axial thermal expansion coefficient $\alpha R$ of the valve shaft 8. Moreover, it is arranged that the distance between the first and second valve-sheets 4 and 5 provided on the inner wall of the valve housing 3 is set so as to be equal with that between the first and second valves 9 and 10 secured on the valve shaft 8 at the normal temperature.

The operation of the EGR valve device of the first embodiment will now be described below.

When the actuator M1 operates in response to a control signal at the time of an engine start, the motor shaft M2 thereof causes the valve shaft 8 to move against an urging force of the spring 13, which carries out a valve-opening operation of the first and second valves 9 and 10 being seated on the first and second valve-sheets 4 and 5, respectively. In the valve-opened state, high-temperature exhaust gas from the engine flows from the inlet port 31 of the valve housing 3 through the primary passage 34 and the secondary passages 35 and 36 to the outlet ports 32 and 33, and then flows out of the outlet ports to circulate through the exhaust-gas recirculation passage 2. In the exhaust gas circulating state, both the valve housing 3 and the valve shaft 8 are heated by the high-temperature circulating exhaust gas; however, the valve housing 3 is exposed to the air in its entirety, and in contrast, the valve shaft 8 is positioned within the high-temperature circulating exhaust gas. On that account, the temperature of the valve housing 3 becomes lower than that of the valve shaft 8, which engenders a temperature difference between the valve housing 3 and the valve shaft 8.

Even though the temperature difference engendered between the valve housing 3 and the valve shaft 8, because it is arranged that the valve housing 3 has an axial thermal expansion coefficient $\alpha H$ larger than that an axial thermal expansion coefficient $\alpha R$ of the valve shaft 8, the valve housing 3 and the valve shaft 8 heated by the circulating exhaust gas have substantially the same axial elongation percentage caused by their respective thermal expansions. This enables the distance between the first and second valve-sheets 4 and 5 integrally disposed on the inner wall of the valve housing 3 to be kept at almost the same as that between the first and second valves 9 and 10 secured on the valve shaft 8. As a result, in closing the exhaust-gas recirculation passage 2 attended with an engine stop or the like, axial movement of the valve shaft 8 in the valve closing direction by an urging force of the spring 13 causes the first and second valves 9 and 10 to almost simultaneously abut and stop on the respective valve-sheets 4 and 5.

According to the first embodiment explained above, it is arranged that the valve housing 3 is formed of material having an axial thermal expansion coefficient $\alpha H$ larger than an axial thermal expansion coefficient $\alpha R$ of the valve shaft 8, and that the distance between the first and second valve-sheets 4 and 5 disposed within the valve housing 3 is set so as to be equal with that between the first and second valves 9 and 10 integrally secured on the valve shaft 8 at the normal temperature. For this reason, though there brings about a temperature difference between the valve housing 3 heated by high-temperature circulation exhaust gas while being exposed to the air, and the valve shaft 8 being replete with circulating exhaust gas while cutting out from the air, the axial elongation percentage caused by the respective thermal expansions of the valve housing 3 and the valve shaft 8 can be made nearly equal each other. This obviates the engenderment of a difference between the distance between the first and second valve-sheets 4 and 5, and that between the first and second valves 9 and 10. Accordingly, this favorable advantage accomplishes more great reduction of the circulating exhaust gas leaking from the small gap formed between the other valve 10 and valve-sheet 5 than the conventional built-in type EGR valve device under the condition that one valve 9 abutted on the other valve-sheet 4. In addition, owing to the desirable arrangement in which the distance between the first and second valve-sheets 4 and 5 is set so as to be equal with that between the first and second valves 9 and 10 at the normal temperature, it allows reduction of the circulating exhaust gas leaking from the small gap formed between the other valve 10 and valve-sheet 5 under the condition that one valve 9 abutted on the other valve-sheet 4, even when the exhaust-gas recirculation passage 2 is closed at the normal temperature.

EXAMPLE 1

An explanation of the measured results of the valve housing 3 and the valve shaft 8 is given below with high-temperature exhaust gas being actually circulated through the valve housing 3 of the EGR valve device 1 according to the first embodiment, and with the temperature of the circulating exhaust gas being gradually increased.

In Example 1, as discussed in the first embodiment, the valve housing 3 is formed of niresist having a thermal expansion coefficient $\alpha H$ of about 17.8E−6/° C. and the valve shaft 8 is formed of stainless steel having a thermal expansion coefficient $\alpha H$ of about 13.6E−6/° C. Moreover, it is arranged that the distance between the two valve-sheets 4 and 5 is set so as to be equal space (50 mm) with that between the valves 9 and 10 at a normal temperature (25° C.). The temperature of the exhaust gas circulating through the valve housing 3 is raised under such a condition, and the temperature of the circulating exhaust gas, the valve housing 3, and the valve shaft 8 are measured. Here, the temperature of the valve housing 3 is measured at the housing wall located between the two valve-sheets 4 and 5, and the temperature of the valve shaft 8 is measured between the two valves 9 and 10. The results are listed in Table 1.

TABLE 1

| Temperature of Circulating Exhaust Gas (° C.) | Temperature of Housing (° C.) | Temperature of Valve Shaft (° C.) | Distance between Valve Sheets (mm) | Distance between Valves (mm) | Gap (mm) |
|---|---|---|---|---|---|
| 25 | 25 | 25 | 50.00 | 50.00 | 0.00 |
| 100 | 80 | 100 | 50.05 | 50.05 | 0.00 |
| 200 | 160 | 200 | 50.12 | 50.12 | 0.00 |
| 300 | 235 | 300 | 50.19 | 50.19 | 0.00 |
| 400 | 310 | 400 | 50.25 | 50.26 | 0.01 |

As can be seen from Table 1, although each of the temperatures of the valve housing 3 (in Table 1, referred to simply as "housing") and the valve shaft 8 raise as the temperature of the circulating exhaust gas goes down, it follows that the distance between the two valve-sheets 4 and 5 comes to almost the same as that between the two valves 9 and 10. The gap, which formed between the other valve 10 and the valve-sheet 5 is very narrow under the condition that one valve 9 abutted on the valve-sheet 4; and leakage of the circulating exhaust gas from the gap is extremely small.

In particular, it will be noted from Table 1 that the distance between the two valve-sheets 4 and 5 comes to absolutely the same as that between the two valves 9 and 10 within the temperature rising range of the circulating exhaust gas of from 25° C. (normal temperature) up to 300° C., and no gap is formed between the two valves 9 and 10 and their respective valve-sheets 4 and 5, with the valves 9 and 10 being opened within the temperature rising range of up to 300° C. as described above. Moreover, when circulating exhaust gas is heated up to 400° C., the distance between the two valve-sheets 4 and 5 amounts to 50.25 mm due to a thermal expansion of the valve housing 3; the distance between the two valves 9 and 10 amounts to 50.26 mm due to thermal expansion of the valve shaft 8. Then, a small gap of 0.01 mm formed between the other valve 10 and the valve-sheet 5 has observed under the condition that one valve 9 abutted on the valve-sheet 4; however, leakage of the circulating exhaust gas from the gap is extremely small.

For the purpose of comparing with the prior art, a trial of temperature measurement is made under the condition that the valve housing 3 and the valve shaft 8 are each formed of the same material, i.e., stainless steel of the same coefficient of linear expansion, and the other conditions as in the case of Example 1 except the same material is adopted. The results are listed in Table 2.

TABLE 2

| Temperature of Circulating Exhaust Gas (° C.) | Temperature of Housing (° C.) | Temperature of Valve Shaft (° C.) | Distance between Valve Sheets (mm) | Distance between Valves (mm) | Gap (mm) |
|---|---|---|---|---|---|
| 25 | 25 | 25 | 50.00 | 50.00 | 0.00 |
| 100 | 80 | 100 | 50.04 | 50.05 | 0.01 |
| 200 | 160 | 200 | 50.09 | 50.12 | 0.03 |
| 300 | 235 | 300 | 50.14 | 50.19 | 0.05 |
| 400 | 310 | 400 | 50.19 | 50.26 | 0.07 |

As can be seen from Table 2, the higher the temperature of the valve housing 3 and the valve shaft 8, the larger the difference of the distance between the two valve-sheets 4 and 5, and that between the two valves 9 and 10 as the temperature of the circulating exhaust gas rises. Consequently, the gap, which formed between one valve 10 and the valve-sheet 5 under the condition that the other valve 9 abutted on the valve-sheet 4 widens with rising temperature thereof, and leakage of the circulating exhaust gas from the gap increased more greatly than Example 1.

Second Embodiment

Figure 2:
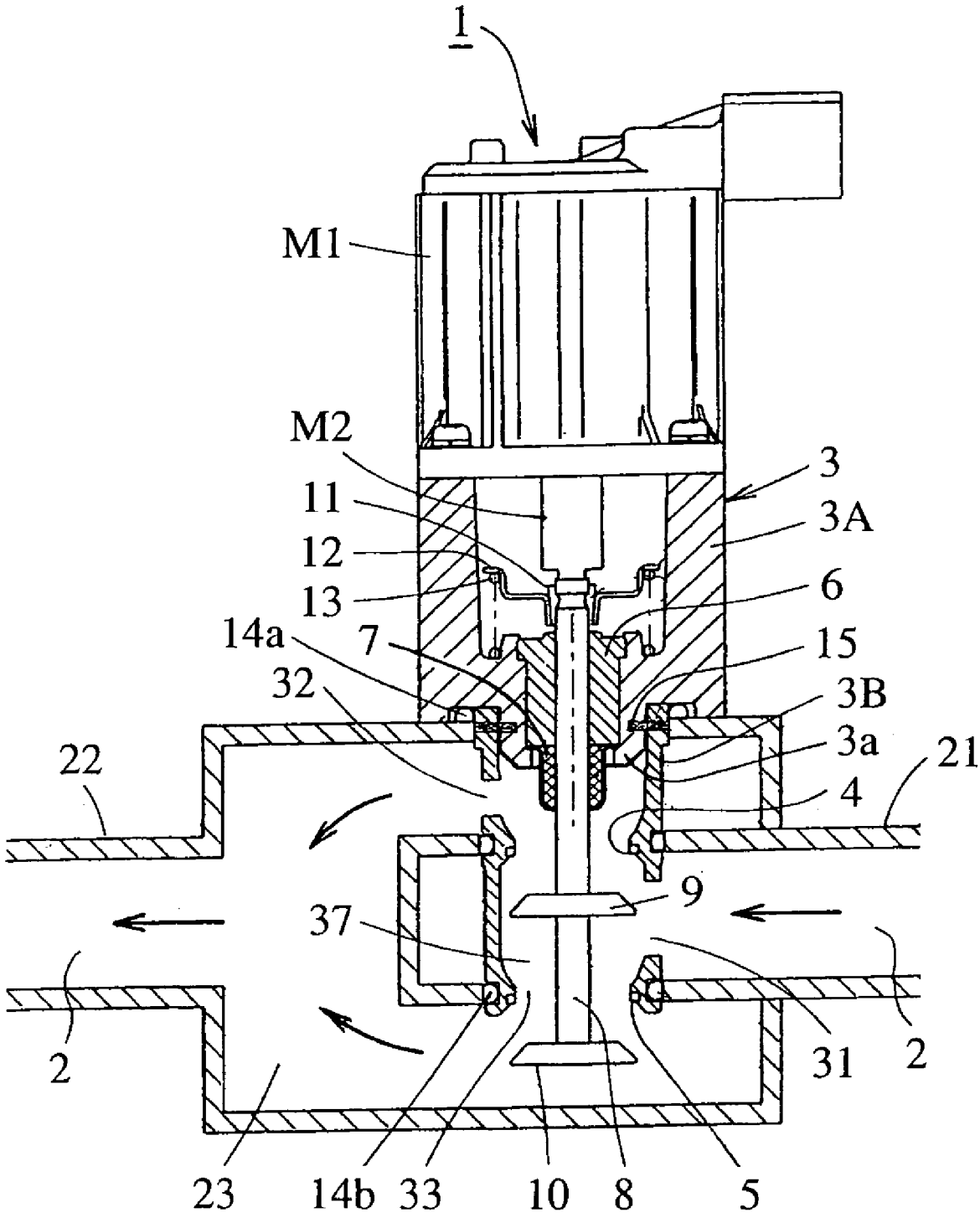
FIG. 2 is a sectional view showing a drop-in type EGR valve device according to a second embodiment of the present invention.

FIG. 2 is a sectional view showing a drop-in type EGR valve device according to a second embodiment of the present invention. The same reference numerals designate the same or equivalent parts as in FIG. 1, and a the repetitive explanation is omitted for brevity's sake.

In the second embodiment, that part or most of a valve housing 3 is assembled into an exhaust-gas recirculation passage 2 characterizes the arrangement thereof. Going into the details, in the second embodiment, the valve housing 3 is formed in a structure divided into a first housing member 3A installed outside the exhaust-gas recirculation passage (exhaust gas recirculation pipe) 2, and a second housing member 3B connected with the first housing member 3A and disposed within the exhaust-gas recirculation passage 2. Further, the second housing member 3B is made up of material having an axial thermal expansion coefficient $\alpha H$ larger than an axial thermal expansion coefficient $\alpha R$ of a valve shaft 8. As to the first housing member 3A installed outside the exhaust-gas recirculation passage 2, one is exempted from a consideration of the relationship between the thermal expansion coefficient thereof and the valve shaft 8, and so may properly select low-cost material.

In the above structure of the valve device, the valve shaft 8 having the first and second valves 9 and 10 and axially movable, some parts related to this system (valve shaft), and an actuator M1 are assembled into the first housing member 3A. Moreover, the second housing member 3B has one inlet port 31 connected with the primary side of the exhaust-gas recirculation passage 2 and two outlet ports 32 and 33 connected with the secondary side of the exhaust-gas recirculation passage 2, and the second housing member forms an exhaust-gas passage 37 branching out from the inlet port 31 and leading to the two outlet ports 32 and 33. In addition, in the inner peripheral face of the second housing member 3B, first and second valve-sheets 4 and 5 are disposed at equal spaces with that between the first and second valves 9 and 10.

Here, the exhaust-gas recirculation passage 2 is composed of a primary pipe line 21 connected with the inlet port 31 of the second housing member 3B and a secondary pipe line 22 forming a merging-space portion 23 for connecting with the outlet ports 32 and 33 of the second housing member 3B, and merging together circulating exhaust gas flowing out of each of the outlet ports 32 and 33. Further, it is arranged that the primary pipe line 21 extends to the merging-space portion 23 of the secondary pipe line 22, and that both the pipe line 21 and the pipe line 22 are united. Furthermore, the first housing member 3A has a boss 3*a* on the side thereof connected with the second housing member 3B. The boss part 3*a* is press fitted into the inside of the second housing member 3B on the top side thereof, and a fastening pin 15 is driven into the press-fitting portion to thereby firmly connect the first and second housing members 3A and 3B together. In this way, the second housing member 3B, which is connected with the first housing member 3A penetrates through the wall of the merging-space portion 23 of the secondary pipe line 22 and the primary pipe line 21 extending to the merging-space portion 23, and the inlet port 31 is opened to the primary pipe line 21, as well as the outlet ports 32 and 33 are opened to the merging-space portion 23. In the state of the above arrangement, the end face positioned on the boss 3*a* side of the first housing member 3A abuts the outside wall face of the merging-space portion 23, and sealants 14*a* and 14*b* are interposed between the outside wall face thereof and the first housing member 3A and further in the penetrating portion of the second housing member 3B in the primary pipe line 21.

The operation of the EGR valve device of the second embodiment will now be described below.

In the state where the first and second valves 9 and 10 are opened, high-temperature exhaust gas flowing into the second housing members 3B from the primary pipe line 21 of the exhaust-gas recirculation passage 2 is split into the first outlet port 32 and the second outlet port 33 within the second housing members 3B, flows from these outlet ports 32 and 33 to the merging-space portion 23 of the secondary pipe line 22 in the exhaust-gas recirculation passage 2, and returns to the combustion chamber of the engine.

In such a drop-in type EGR valve device 1, the second housing member 3B forming a portion of the valve housing 3 is assembled into the exhaust-gas recirculation passage 2, and therefore both the second housing member 3B and the valve shafts 8 located within the housing member 3B are heated by high-temperature exhaust gas circulating through the exhaust-gas recirculation passage 2. However, a temperature difference engenders between the second housing member 3B and the valve shaft 8. That is, because the second housing member 3B is assembled into the primary pipe line 21 and the secondary pipe line 22 of the exhaust-gas recirculation passage 2, heat of the second housing member 3B heated by the high-temperature circulating exhaust gas is propagated to the exhaust-gas recirculation passage 2 (primary pipe line 21 and secondary pipe line 22). However, since the exhaust-gas recirculation passage 2 is exposed to the air, and the temperature of the second housing member 3B becomes lower than that of the valve shaft 8 which is being replete with the circulating exhaust gas. If these housing member 3B and valve shaft 8 are formed of material of the same thermal expansion coefficient brings about a difference between the axial elongation percentage caused by their respective thermal expansions attributable to the engenderment of the temperature difference between the second housing member 3B and the valve shaft 8, the distance between the two valve-sheets 4 and 5 differs from that between the two valves 9 and 10.

However, in the second embodiment, the second housing member 3B, which is assembled into the exhaust-gas recirculation passage 2, is formed of material having an axial thermal expansion coefficient $\alpha H$ larger than an axial thermal expansion coefficient $\alpha R$ of the valve shaft 8, as with the valve housing 3 in the first embodiment. Consequently, even when a temperature difference engendered between the second housing member 3B and the valve shaft 8 heated by the high-temperature circulating exhaust gas, the second housing member 3B and the valve shaft 8 may have substantially the same axial elongation caused by the respective thermal expansions. For this reason, the distance between the two valve-sheets 4 and 5 and that between the two valves 9 and 10 are kept almost the same, which abuts the two valves 9 and 10 to almost simultaneously on their respective valve-sheets 4 and 5 and stops when closing the exhaust-gas recirculation passage 2.

According to the second embodiment explained above, the valve housing 3 in the drop-in type EGR valve device 1 is formed in a structure divided into the first housing member 3A installed outside the exhaust-gas recirculation passage 2 and the second housing member 3B onnected with the first housing member 3A and assembled into the exhaust-gas recirculation passage 2, and the second housing member 3B is formed of material having an axial thermal expansion coefficient $\alpha H$ larger than an axial thermal expansion coefficient $\alpha R$ of the valve shaft 8. Therefore, even if a temperature difference brought about between the second housing member 3B and the valve shaft 8 both heated by the high-temperature circulating exhaust gas, the axial elongation percentage caused by the respective thermal expansions of the second housing member 3B and the valve shaft 8 comes to almost the same each other. Accordingly, when the exhaust-gas recirculation passage 2 is closed, a minute gap, formed between the other valve 10 and valve-sheet 5 in the state where one valve 9 abutted on the valve-sheet 4, prevented its increase traceable to the temperature difference between the second housing member 3B and the valve shaft 8. This reduces leakage of the circulating exhaust gas at the time of closing the valves. Further, because the first housing member 3A installed outside the exhaust-gas recirculation passage 2 relieves from a consideration of the relationship of the magnitude of thermal expansion coefficient and the valve shaft 8, the first housing member can be formed of such a low-cost material as aluminum.

In addition, according to the second embodiment, since it is arranged that the first housing member 3A and the second housing member 3B are connected through press-fitting, and that the fastening pin 15 is driven into the press-fitting connection portion, the arrangement promises sufficient joint strength between the first and second housing members 3A and 3B. Here, merely forming the first housing member 3A with material different from that of the second housing member 3B, and connecting both the housing members through press-fitting become difficult to secure the joint strength between the first and second housing members 3A and 3B where the strength of the material of at least one housing member is weak, or because the press-fitting connection portion between the first and second housing members 3A and 3B plastically deforms due to a repeated load imposed by their thermal expansion and contraction. However, according to the second embodiment, even if whatever material is selected for the housing members 3A and 3B, the fastening pin 15 secures sufficient joint strength between the housing members 3A and 3B.

Third Embodiment

Figure 3:
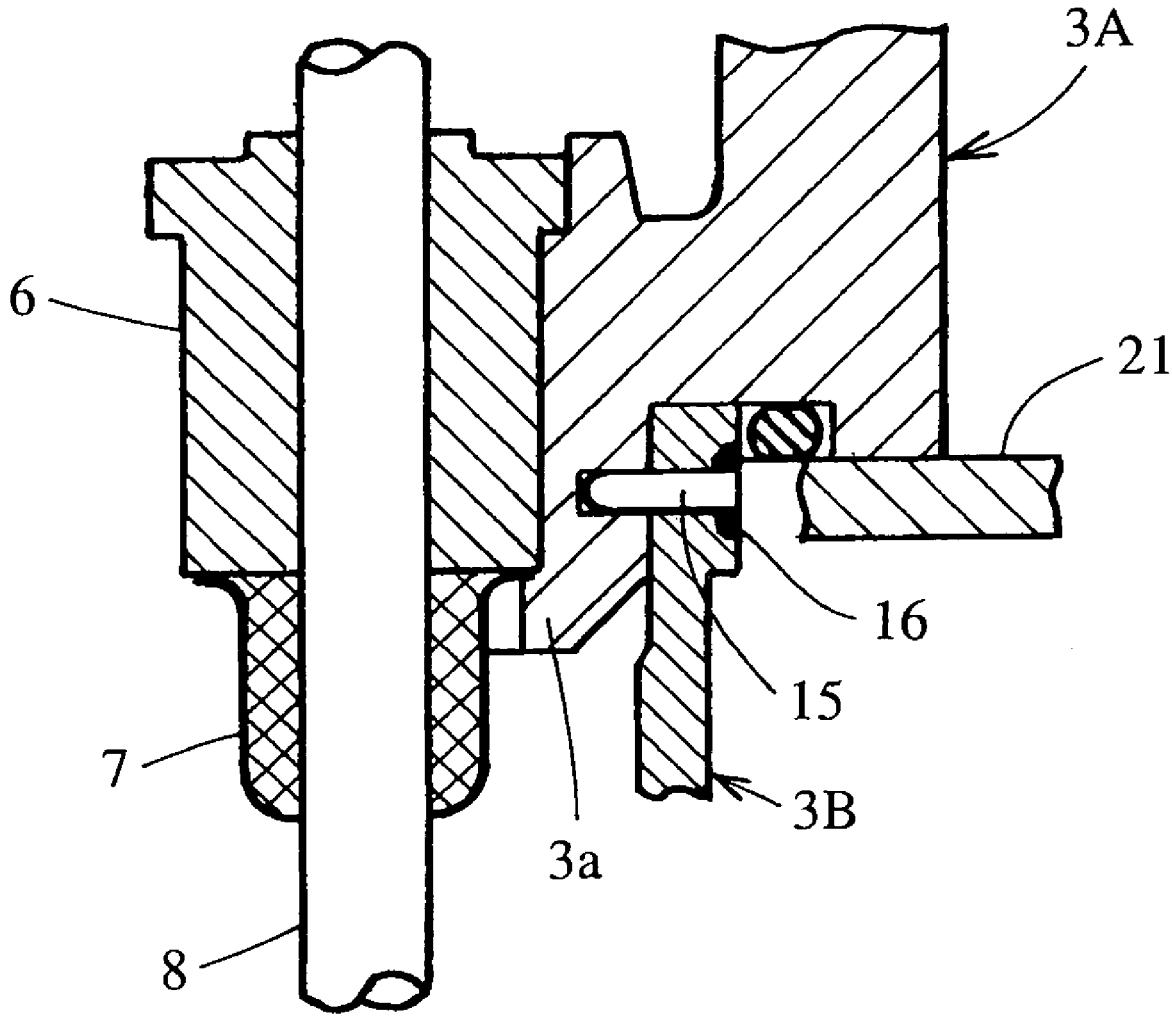
FIG. 3 is a sectional view showing essential parts of an EGR valve device according to a third embodiment of the present invention.

FIG. 3 is a sectional view showing essential parts of an EGR valve device according to the third embodiment of the present invention. The same reference numerals designate the same parts as FIG. 2 of the third embodiment, and thus a repetitive explanation is omitted for brevity's sake.

In the third embodiment of the drop-in type EGR valve device 1 according to the second embodiment, the fastening pin 15 driven into the press-fitting portion between the first housing member 3A and the second housing member 3B is welded to the outside wall of the press-fitting part (outside wall face on the top end side of the second housing member 3B in FIG. 3) The welded portion is designated by reference numeral 16.

According to the third embodiment in which the fastening pin 15 driven to the press-fitting portion between the first and second housing members 3A and 3B are welded to the outside wall of the press-fitting portion, the housing members 3A and 3B can be more strongly connected than the second embodiment.

Fourth Embodiment

FIG. 4A is a view showing the exhaust-gas inlet port of an EGR valve device in a valve-closed state, according to a fourth embodiment of the present invention, and FIG. 4B is a view showing the FIG. 4A in a valve-opened state. The same reference numerals in the fourth embodiment designate the same parts as FIG. 2, and thus a repetitive explanation is omitted for brevity's sake.

According to the fourth embodiment, the exhaust-gas inlet port 31 of the second housing member 3B used in the drop-in type EGR valve device 1 according to the second embodiment is formed such that its opening conforms with the shape of the valve 9 located between the valve-sheets 4 and 5.

Figure 4:
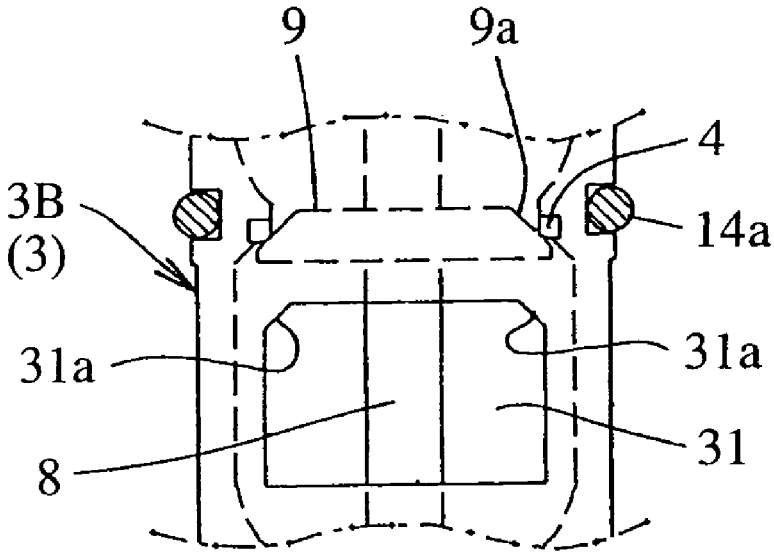
FIG. 4A is a view showing an exhaust-gas inlet port of an EGR valve device in a valve-closed state according to a fourth embodiment of the present invention.
FIG. 4B is a view showing the FIG. 4A in a valve-opened state.
Figure 4:
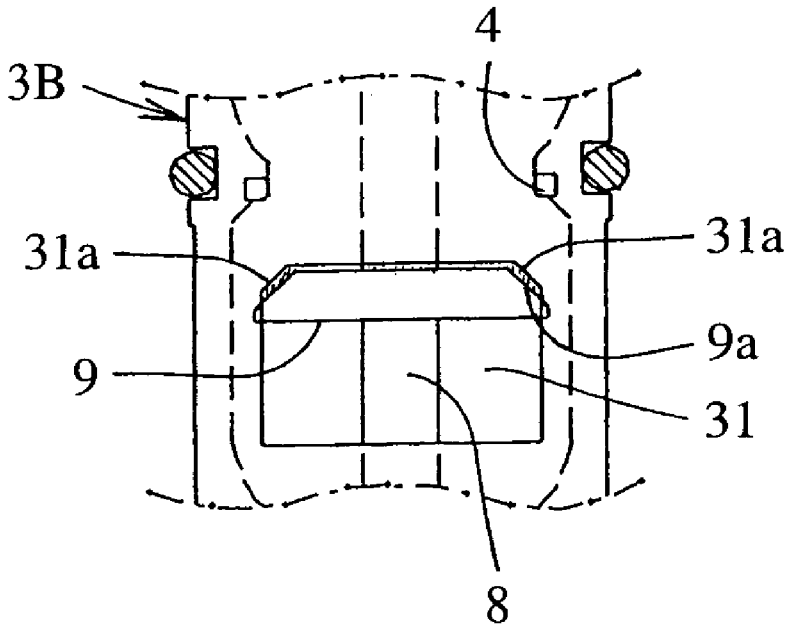
Figure 5:
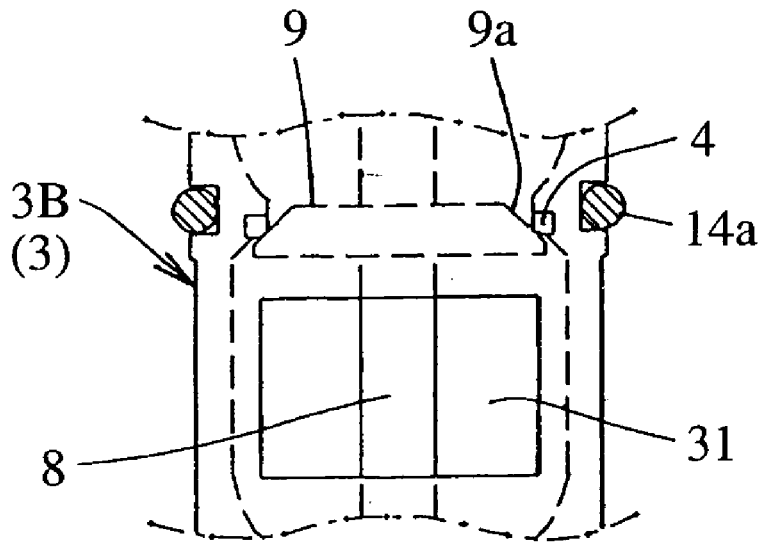
FIG. 5 is a reference drawing given only as an example for purpose of comparing with FIG. 4.
Figure 5:
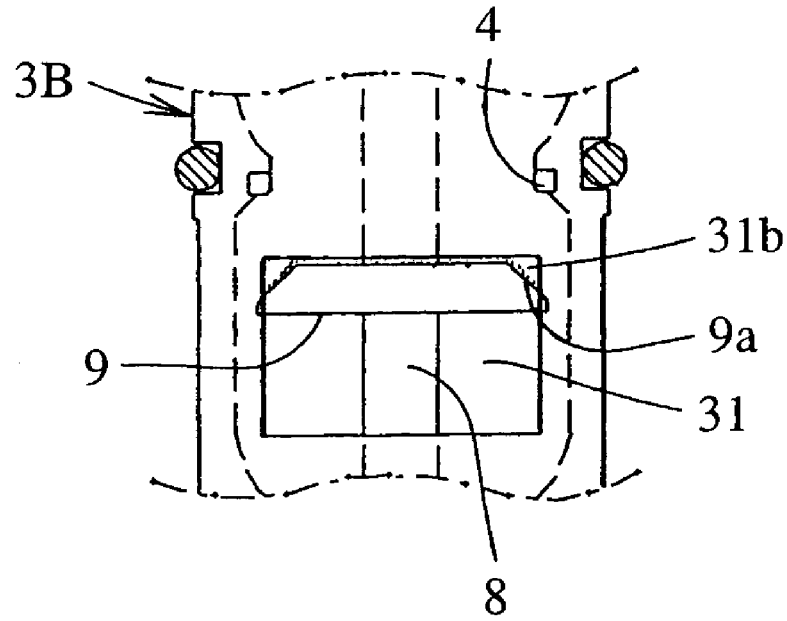

A more detailed explanation will now be given by reference to FIG. 5. It should be noted that FIG. 5 is a reference drawing exemplified for the purpose of comparing with FIG. 4.

In the drop-in type EGR valve device 1 shown in FIG. 2, since the second housing member 3B forming the lower portion of the valve housing 3 is assembled into the primary pipe line 21 extending to the merging-space portion 23 of the exhaust-gas recirculation passage 2, the EGR valve device has a structure in which the exhaust-gas inlet port 31 opened within the primary pipe line 21, the two valve-sheets 4 and 5, and the valve 9 located between these valve-sheets 4 and 5 are close to each other. Normally, the first and second valves 9 and 10 secured on the valve shaft 8 each have an outer peripheral face formed in tapered shape. In FIG. 4, only the tapered faces 9*a* of the first valve 9 located between both the valve-sheets 4 and 5 are shown.

When the valve 9, which is formed in such tapered shape, opened as shown in FIG. 5B from the valve-closed position shown in FIG. 5A, the valve is positioned correspondingly to the top of the opened area of the exhaust-gas inlet port 31. At that time, if the exhaust-gas inlet port 31 is formed in square shape, the upper corners 31*b* of the exhaust-gas inlet port 31, which are proximate to the tapered faces 9*a* of the valve 9 in a valve-opened position, cause turbulence to be produced in the circulating exhaust gas flowing in from the exhaust-gas inlet port 31.

To this end, in the drop-in type EGR valve device 1 shown in FIG. 2 of the fourth embodiment, when the valve 9 located between the two valve-sheets 4 and 5 situates in the valve-opened position shown in FIG. 4B, tapered faces 31*a*, which are parallel to the respective tapered faces 9*a* of the valve 9 viewed from the front face of the exhaust-gas inlet port 31, are formed at the upper corners of the exhaust-gas inlet port 31, to which the valve 9 is proximate. In other words, the exhaust-gas inlet port 31 according to the fourth embodiment is constructed virtually in the form of a square having the tapered faces 31*a* at the corners of its opening, which are formed along the tapered faces 9*a* of the valve 9.

According to the fourth embodiment described above, in the drop-in type EGR valve device 1 shown in FIG. 2, it is arranged that the exhaust-gas inlet port 31 of the housing member 3B to be assembled into the primary pipe line 21 of the exhaust-gas recirculation passage 2 is constructed practically in the form of a square having tapered faces 31*a*, along the tapered faces 9*a* of the valve 9 in the valve-opened position, at the corners of opening. As a result, there produces no turbulence in the circulating exhaust gas flowing into the housing member 3B from the exhaust-gas inlet port 31, which enables smooth flowing of the circulating exhaust gas.

What is claimed is:

1. An EGR valve comprising:

a valve housing having one or more exhaust-gas inlet ports and two or more exhaust-gas outlet ports, which is connectable to the exhaust-gas recirculation passage of an engine, and forming an exhaust-gas passage communicated with these exhaust-gas inlet ports and exhaust-gas outlet ports;

first and second valve-sheets disposed on the inner peripheral face of the valve housing;

a valve shaft axially movably assembled into the valve housing; and first and second valves secured on the valve shaft, and almost simultaneously abut on the first and second valve-sheets, respectively to close the exhaust-gas recirculation passage when the valve shaft moves in one direction, wherein the valve housing is formed of material having an axial thermal expansion coefficient larger than that of the valve shaft, located at least between the first valve-sheet and the second valve-sheet, and the distance between the first valve-sheet and the second valve-sheet is set so as to be equal with that between the first valve and the second valve at the normal temperature.

2. The EGR valve according to claim 1, wherein part or most of the valve housing is assembled inside the exhaust-gas recirculation passage.

3. The EGR valve according to claim 1, wherein the valve housing is formed in a structure divided into a first housing member into which the valve shaft having the first and second valves is assembled movably in the axial direction thereof and fitted to outside the exhaust-gas recirculation passage, and a second housing member disposed inside the exhaust-gas recirculation passage with it connected with the first housing member, having one or more exhaust-gas inlet ports and two or more exhaust-gas outlet ports, the first and second valve-sheets being disposed on the inner peripheral face of the second housing member; and wherein the second housing member is formed of material having an axial thermal expansion coefficient larger than an axial thermal expansion coefficient $\alpha R$ of the valve shaft.

4. The EGR valve according to claim 3, wherein the first housing member and the second housing member are connected through press fitting, and a fastening pin is driven into the press-fitted and connected portion.

5. The EGR valve according to claim 4, wherein the fastening pin is welded to the outside wall of the press-fitted and connected portion between the first housing member and the second housing member.

6. The EGR valve according to claim 1, wherein the exhaust-gas inlet port of the valve housing is formed virtually in a shape of a square having a tapered face formed along the outer peripheral face of the valve, at the corner of opening of the port.

* * * * *